US009202454B2

(12) United States Patent
Choi et al.

(10) Patent No.: US 9,202,454 B2
(45) Date of Patent: Dec. 1, 2015

(54) METHOD AND APPARATUS FOR AUDIO ENCODING FOR NOISE REDUCTION

(71) Applicants: SAMSUNG ELECTRONICS CO., LTD., Suwon-si, Gyeonggi-do (KR); GWANGJU INSTITUTE OF SCIENCE AND TECHNOLOGY, Gwangju (KR)

(72) Inventors: Myung-kyu Choi, Suwon-si (KR); Sang-ryong Kim, Yongin-si (KR); Seong-woon Kim, Seongnam-si (KR); Ung-sik Kim, Suwon-si (KR); Kwang-il Hwang, Suwon-si (KR); Duk-soo Kim, Gwangju (KR); Hong-kook Kim, Gwangju (KR); Nam-in Park, Gwangju (KR); Kwang-myung Jeon, Gwangju (KR)

(73) Assignees: SAMSUNG ELECTRONICS CO., LTD., Suwon-Si (KR); GWANGJU INSTITUTE OF SCIENCE AND TECHNOLOGY, Gwangju (KR)

( * ) Notice: Subject to any disclaimer, the term of this patent is extended or adjusted under 35 U.S.C. 154(b) by 353 days.

(21) Appl. No.: 13/755,119

(22) Filed: Jan. 31, 2013

(65) Prior Publication Data

US 2013/0262129 A1 Oct. 3, 2013

(30) Foreign Application Priority Data

Mar. 28, 2012 (KR) ..... 10-2012-0031827

(51) Int. Cl.

| | |
|---|---|
| ***G10L 21/00*** | (2013.01) |
| ***G10L 21/02*** | (2013.01) |
| ***G10L 19/00*** | (2013.01) |
| ***G10K 11/00*** | (2006.01) |
| ***G10L 19/02*** | (2013.01) |

(52) U.S. Cl.
CPC ..... *G10K 11/002* (2013.01); *G10L 19/0212* (2013.01)

(58) Field of Classification Search
USPC ..... 704/200–230, 500–504
See application file for complete search history.

(56) References Cited

U.S. PATENT DOCUMENTS

| | | | | |
|---|---|---|---|---|
| 2004/0158472 | A1* | 8/2004 | Voessing | 704/500 |
| 2007/0055507 | A1* | 3/2007 | Jin et al. | 704/226 |
| 2010/0217607 | A1* | 8/2010 | Neuendorf et al. | 704/500 |
| 2011/0010168 | A1* | 1/2011 | Yu et al. | 704/219 |
| 2011/0178795 | A1* | 7/2011 | Bayer et al. | 704/205 |
| 2012/0209600 | A1* | 8/2012 | Kim et al. | 704/219 |

OTHER PUBLICATIONS

Tsai et al. "An MDCT-Based Psychoacoustic Model for Co-Processor Design for MPEG-2/4 AAC Audio Encoder". Proc. of the 7th Int. Conf. on Digital Audio Effects, Naples, Italy, Oct. 5-8, 2004.*

Chowdhury et al., "Perceptually weighted multi-band spectral subtraction speech enhancement technique," Proc. 5th International Conference on Electrical and Computer Engineering, ICECE 2008, Dec. 20-22, 2008, Dhaka, Bangladesh, pp. 20-22 (Dec. 2008).

* cited by examiner

*Primary Examiner* — Jesse Pullias
(74) *Attorney, Agent, or Firm* — Drinker Biddle & Reath LLP

(57) ABSTRACT

A method and apparatus for audio signal encoding for noise reduction are provided. The method includes: receiving an audio signal and performing modified discrete cosine transformation (MDCT) on the audio signal to convert the audio signal into a long block or a short block; reducing noise included in the audio signal in accordance with the long block or the short block; and performing advanced audio coding (AAC) on the long block or the short block in which noise is reduced.

18 Claims, 8 Drawing Sheets

FIG. 8

```
i := 0; N := 0; S_thr := 3; B_num := 49;
repeat
    if S_b (i) < S_thr
    then
        N := N + 1;
    i := i + 1;
until i ≤ B_num
if N > 0.6 x B_num
then
   f_current = NOISE
else
```

METHOD AND APPARATUS FOR AUDIO ENCODING FOR NOISE REDUCTION

CROSS-REFERENCE TO RELATED PATENT APPLICATION

This application claims the priority benefit of Korean Patent Application No. 10-2012-0031827, filed on Mar. 28, 2012, in the Korean Intellectual Property Office, the disclosure of which is incorporated herein in its entirety by reference.

BACKGROUND

Various embodiments relate to noise reduction, and more particularly, to a method and apparatus for encoding an audio signal, for noise reduction.

Recently, communication services such as the Internet or satellite broadcasting are widely supplied, and also, audio-video (AV) devices such as digital versatile disks (DVDs) are also widely supplied. In accordance with the supply of these services and devices, demand for audio encoding involving efficiently compressing audio signals is increasing. Currently, adaptive conversion audio encoding apparatuses that take into consideration human hearing are mainly used. In such encoding processes, an audio signal which is in a time domain is converted into a frequency domain. In addition, a signal along a frequency axis is partitioned into frequency bands corresponding to frequency resolving power of hearing. Moreover, by considering human hearing, an optimal amount of data needed for encoding in each frequency band is calculated.

According to the data amount allocated to each of the frequency bands, the signal along the frequency axis is quantized. An example of an adaptive conversion audio encoding apparatus is a Moving Picture Experts Group (MPEG)-Advanced Audio Coding (2AAC) method that is standardized by the International Organization for Standardization (ISO)/International Electrotechnical Commission (IEC). Advanced audio coding (AAC, standard document: ISO/IEC 13818-7) is a standard lossy data compression method used in digital audio devices.

AAC provides more sample frequencies from 8 kHz to 96 kHz and up to 48 channels, and in AAC, bits may be variably allocated according to necessity even at a constant bit rate, and an audio signal may be changed into a modified discrete cosine transformation (MDCT) format, thereby enabling more efficient coding.

SUMMARY

Various embodiments provide a noise reduction method that corresponds to frame size conversion characteristics in a modified discrete cosine transformation (MDCT) area of Moving Picture Experts Group Advanced Audio Coding (MPEG AAC), and more particularly, a method and apparatus for AAC for noise reduction while reducing a calculation amount but maintaining noise reduction performance.

According to an embodiment, there is provided an audio signal coding method for noise reduction, the method includes: receiving an audio signal and performing modified discrete cosine transformation (MDCT) on the audio signal to convert the audio signal into long blocks or short blocks; reducing noise of the audio signal in accordance with a long block or a short block; and performing advanced audio coding (AAC) on the long block or the short block in which noise is reduced.

In the reducing of noise, a non-linear multi-band spectral subtraction may be performed to the long block, and a spectral reduction may be performed to the short block based on the spectral subtraction of the long block.

The reducing of noise may include: dividing the long block into a plurality of sub-bands; measuring a signal-to-noise ratio (SNR) of each of the plurality of sub-bands; and performing spectral subtraction based on information about a perceptual sound quality curve corresponding to the measured SNR and a subtraction coefficient calculated in consideration of a weight of each of the plurality of sub-bands.

The method may further include performing over-subtraction by amplifying the subtraction coefficient, and performing masking using an audio signal corresponding to the reduced long block.

A noise reduction rate with respect to the short block may be determined by comparing an average power of an audio signal of a predetermined range according to noise reduction of the long block and an average power of an audio signal of the predetermined range of a short block corresponding to the long block.

The reducing of noise may be performed based on a variable frame length of the audio signal needed for the AAC and a non-linear scale factor band.

The reducing of noise may be performed using a MDCT coefficient according to the MDCT.

The reducing of noise may be performed by dividing the audio signal into a long block of 1024 points or a short block of 128 points according to block switching of the AAC.

The method may further include storing the audio signal, to which the AAC is performed, in a recording medium.

The reducing of noise may be performed by dividing the long block into $49^{th}$ order non-uniform sub-bands.

The reducing of noise may be performed by dividing the short block into $14^{th}$ order non-uniform sub-bands.

According to another embodiment, there is provided a non-transitory computer readable recording medium having embodied thereon a program for executing the method of claim 1 on a computer.

According to another embodiment, there is provided an audio signal encoding apparatus including: a modified discrete cosine transformation (MDCT) converting unit that receives an audio signal and performing MDCT on the audio signal to convert the audio signal into long blocks or short blocks; a noise reducing unit that reduces noise in the audio signal in accordance with a long block and a short block; and an advanced audio coding (AAC) encoding unit that performs AAC on the long block or the short block in which noise is reduced.

The noise reducing unit may perform non-linear multi-band spectral subtraction on the long block, and spectral reduction on the short block based on the spectral subtraction of the long block.

The noise reducing unit may include: a long block sub-band dividing unit that divides the long block into a plurality of sub-bands; a SNR measuring unit that measures a SNR of each of the plurality of sub-bands; a subtracting unit that performs spectral subtraction based on information about a perceptual sound curve corresponding to the measured SNR and a weight for each of the plurality of sub-bands; and a masking unit that performs over-subtraction by amplifying the subtraction coefficient, and performs masking using an audio signal corresponding to the reduced long block.

The noise reducing unit may include: a short block sub-band dividing unit that divides the short block into a plurality of sub-bands; a power matching unit that compares an average power of an audio signal of a predetermined range according to noise reduction of the long block and an average power of an audio signal of the predetermined range of a short block corresponding to the long block provided by the masking unit, and determines a reduction rate of the short block; and a reducing unit that performs noise reduction on the short block according to the determined reduction rate.

The noise reducing unit may perform noise reduction based on a variable frame length of the audio signal needed for the AAC and a non-linear scale factor band.

The noise reducing unit may perform noise reduction using a MDCT coefficient output from the MDCT unit.

The noise reducing unit may perform noise reduction by dividing the audio signal into a long block of 1024 points or a short block of 128 points according to block switching of the AAC.

The noise reducing unit may perform noise reduction by dividing the long block into $49^{th}$ order non-uniform sub-bands, and by dividing the short block into $14^{th}$ order non-uniform sub-bands.

BRIEF DESCRIPTION OF THE DRAWINGS

The above and other features and advantages will become more apparent by describing in detail exemplary embodiments thereof with reference to the attached drawings in which:

FIG. 8 is pseudo code for explaining a method of determining whether a current frame is signal-centered or noise-centered, according to an embodiment.

DETAILED DESCRIPTION

Figure 1:
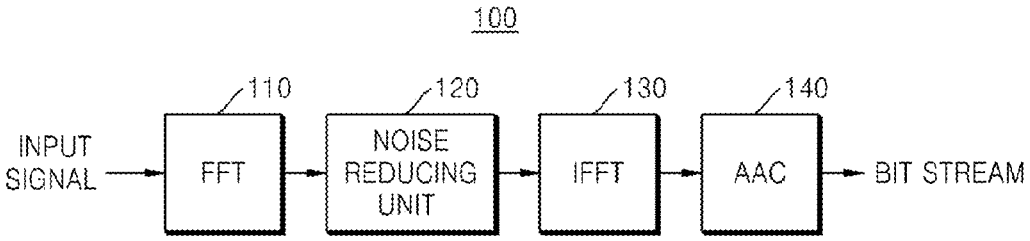
FIG. 1 (Conventional Art)
FIG. 1 is a block diagram for explaining noise reduction in a Moving Picture Experts Group Advanced Audio Coding (MPEG-AAC) coding structure, according to the conventional art.

As the invention allows for various changes and numerous embodiments, particular embodiments will be illustrated in the drawings and described in detail in the written description. However, this is not intended to limit the invention to particular modes of practice, and it is to be appreciated that all changes, equivalents, and substitutes that do not depart from the spirit and technical scope of the invention are encompassed in the invention. In the description of the invention, certain detailed explanations of related art are omitted when it is deemed that they may unnecessarily obscure the essence of the invention.

While such terms as "first," "second," etc., may be used to describe various components, such components must not be limited to the above terms. The above terms are used only to distinguish one component from another.

The terms used in the present specification are merely used to describe particular embodiments, and are not intended to limit the invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Embodiments will be described below in more detail with reference to the accompanying drawings. Those components that are the same or are in correspondence are rendered the same reference numeral regardless of the figure number, and redundant explanations are omitted.

As used herein, the term "and/or" includes any and all combinations of one or more of the associated listed items.

FIG. 1 is a block diagram for explaining a Moving Picture Experts Group Advanced Audio Coding (MPEG-AAC) coding apparatus 100 for noise reduction, according to the conventional art.

Referring to FIG. 1, the MPEG-AAC coding apparatus 100 includes a fast Fourier transform (FFT) unit 110, a noise reducing unit 120, an inverse FFT (IFFT) unit 130, and an advanced audio coding (AAC) unit 140. As illustrated in FIG. 1, reduction or removal of noise according to the conventional art is usually performed before coding an audio signal. For example, an audio signal is divided into frames having the same frame sizes and then noise reduction is performed in a FFT area. Also, when a codec having frame size converting characteristics such as MPEG AAC is used, FFT is performed to convert an audio signal into a frequency domain for noise reduction according to the conventional art, and after performing noise reduction and IFFT, AAC is performed.

As illustrated in FIG. 1, the FFT unit 110 converts an audio signal which is in a time domain into a frequency domain to perform noise reduction, and the IFFT unit 130 converts the signal in the frequency domain, which has undergone noise reduction, into a time domain signal for AAC. Here, calculation amounts of FFT and IFFT are over 50% of the entire process of the MPEG AAC coding apparatus 100, which are highly inefficient calculation amounts to apply to a codec having frame size converting characteristics like MPEG AAC.

Figure 2:
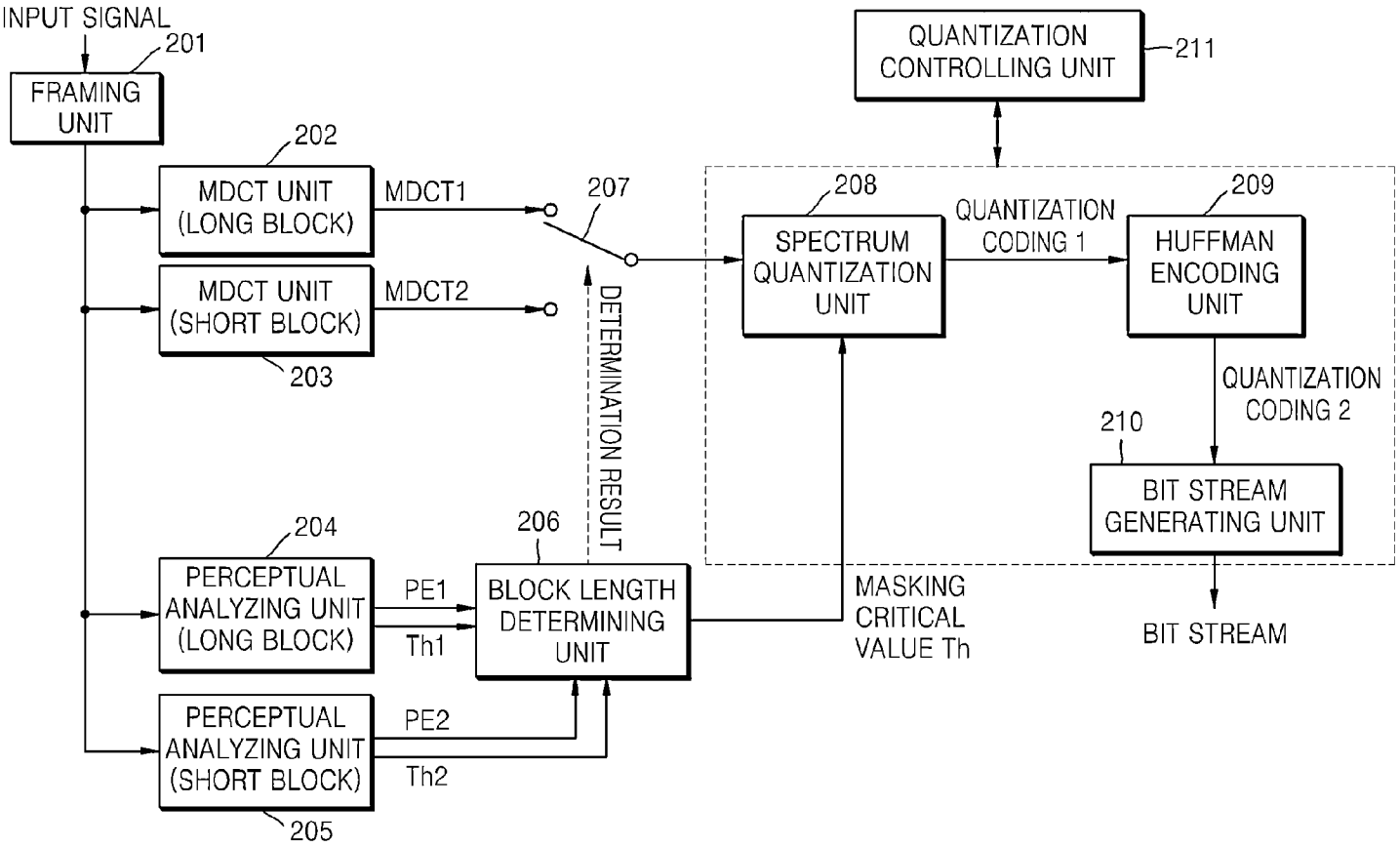
FIG. 2 is a block diagram for explaining MPEG-AAC coding.
Figure 3A:
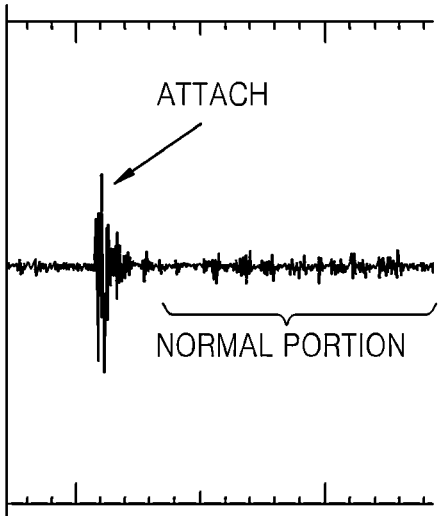
FIGS. 3A to 3C are frequency graphs for explaining MPEG-AAC coding.
Figure 3B:
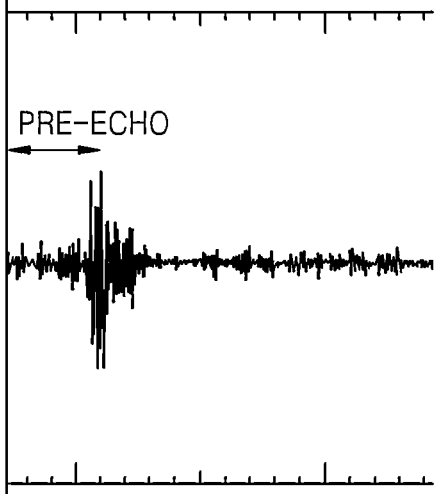
Figure 3C:
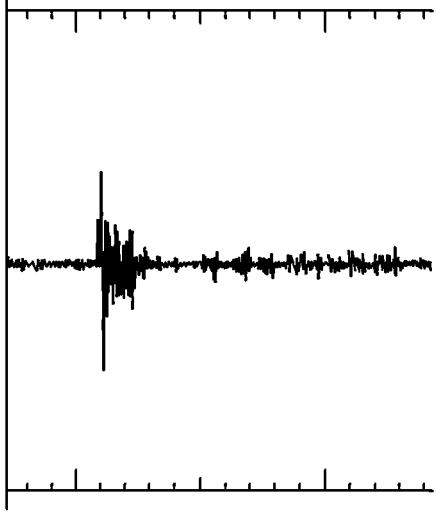

FIG. 2 is a block diagram for explaining MPEG-AAC coding. FIGS. 3A to 3C are frequency graphs for explaining MPEG-AAC coding.

An AAC encoder divides an input signal into frames each consisting of a predetermined number of samples. Then the AAC encoder encodes each of the frames. A frame length according to an AAC method is classified as two types, a long block (1024 samples) and a short block (128 samples). Here, one frame and one block length are equivalent. Hereinafter, a processing order of the AAC encoder illustrated in FIG. 2 will be described.

(1) An input signal is input to a framing unit 201. The framing unit 201 divides an input signal into frames consisting of a predetermined number of samples (long blocks). The signal output from the framing unit 201 is input to a modified discrete cosine transformation (MDCT) unit (hereinafter, "long block MDCT unit") 202 for long blocks and a short block MDCT unit 203 for short blocks.

The long block MDCT unit 202 performs MDCT on 1024 points. Also, the long block MDCT unit 202 calculates a MDCT coefficient (MDCT1). Also, the short block MDCT unit 203 performs MDCT on 128 points with respect to an input signal. Also, the short block MDCT unit 203 calculates a MDCT coefficient (MDCT2). Also, there are eight short blocks for each frame, and thus eight sets of MDCT2 are generated.

(2) The framing unit 201 outputs the divided input signal to a long block perceptual analyzing unit 204. The long block perceptual analyzing unit 204 calculates a long block masking critical value Th1 and a perceptual entropy value PE1 from the input signal. The long block masking critical value Th1 and the perceptual entropy value PE1 are disclosed in a perceptual model of PART 7 of ISO/IEC13818-7, which is the standard document for AAC, and thus a detailed description thereof will be omitted. Likewise, the framing unit 201 outputs the input signal divided into frames to a short block perceptual analyzing unit 205. Then, the short block perceptual analyzing unit 205 calculates a short block masking critical value Th2 and a perceptual entropy value PE2 from the input signal.

The perceptual entropy value refers to an amount of data representing the minimum number of bits needed to quantize a signal. Also, masking refers to a phenomenon whereby if an error when quantizing a signal using a quantizing unit is below a predetermined standard, humans cannot perceive the error. In addition, a reference value denoting a limit of an error that humans cannot perceive is referred to as a masking critical value.

(3) The long block masking critical value Th1 and the perceptual entropy value PE1 and the short block masking critical value Th2 and the perceptual entropy value PE2 are input to a block length determining unit 206. The block length determining unit 206 determines whether to quantize a signal to long blocks or short blocks.

In general, a normal signal whose property hardly changes may preferably be quantized as long blocks. However, when a signal whose amplitude rapidly changes in a block is quantized as a long block, noise referred to as pre-echo, which is not included in the input signal, is generated. The cause of the noise is deterioration of sound quality. FIG. 3B is a schematic view of an example of pre-echo. FIG. 3A is a schematic view of an input signal before encoding the same, and FIG. 3B is a graph showing a decoded sound when encoding an input signal only as a long block. In a front portion of FIG. 3B, there is noise in front of an attach sound, which is not present in the input signal.

The above noise is referred to as pre-echo. Pre-echo may be eliminated by reducing a quantization block length. For example, FIG. 3C is a graph showing a decoded sound when encoding an input signal as a short block. Thus, in the AAC method, the block length determining unit 206 determines properties of an input signal. In addition, the block length determining unit 206 determines an optimal block length for quantization. In detail, when PE1>PE1_thr, the block length determining unit 206 selects a long block, and in other cases, the block length determining unit 206 selects a short block. Here, PE1_thr refers to a previously set critical value (constant).

(4) A result of determination of the block length determining unit 206 is output to a selector 207 for selecting MDCT. Also, a masking critical value selected by the block length determining unit 206 is output to a spectrum quantizing unit 208. That is, when the block length determining unit 206 selects a long block, MDCT1 and Th1 are input to the spectrum quantizing unit 208. Also, when the block length determining unit 206 selects a short block, MDCT2 and Th2 are input to the spectrum quantizing unit 208.

(5) The spectrum quantizing unit 208 quantizes a MDCT coefficient for each frequency band according to the input masking critical value. Then, the spectrum quantizing unit 208 outputs a quantization code 1.

(6) The quantization code 1 output from the spectrum quantizing unit 208 is input to a Huffman encoding unit 209. The Huffman encoding unit 209 converts the quantization code 1 into a quantization code 2 from which redundancy is further eliminated from the quantization code 1.

(7) The quantization code 2 is output from the Huffman encoding unit 209 to a quantization controlling unit 211. Also, the quantization controlling unit 211 calculates a total bit number assigned in the bit streams that are finally output from the input quantization code 2. Also, a range denoted by a dotted line in FIG. 2 is controllable by the quantization controlling unit 211.

(8) When the calculated total bit number is more than an allowed bit number for a current block, the quantization controlling unit 211 controls the spectrum quantization unit 208 and the Huffman encoding unit 209 to repeat operations (5) through (7). Also, when the calculated total bit number is less than the allowed bit number for a current block, the quantization controlling unit 211 controls the Huffman encoding unit 209 to output a quantization code 2 with respect to a bitstream generating unit 210. Also, the quantization controlling unit 211 controls the bitstream generating unit 210 to output a bitstream.

Here, a quantization operation of AAC will be described in detail.

(a) In the AAC method, an exponent portion of a MDCT spectrum is set to an initial value.

(b) In the AAC method, an MDCT spectrum is converted to a power portion and an exponent portion. That is, in the AAC method, an MDCT spectrum is expressed according to floating point representation. Also, in the AAC method, the power portion is quantized (MDCT quantization).

(c) In the AAC method, the number of bits (total bit number) that is required when performing Huffman encoding with respect to the power portion and the exponent portion that are quantized in (b) is calculated.

(d) In the AAC method, when the total bit number calculated in (c) is equal to or less than the allowed quantization bit number for a current frame (the allowed bit number), quantization is completed. In the AAC method, if the total bit number is greater than the allowed bit number, the exponent portion set in (a) is determined as inappropriate. Then in the AAC method, the exponent portion is varied and operations (b) through (d) are repeated. Then, in the AAC method, the exponent portion is determined such that that the total bit number is equal to or less the allowed bit number.

That is, first, the exponent portion is initially fixed in the AAC method. Then, in the AAC method, the power portion is determined to quantize a MDCT spectrum. Next, a total bit number at which a quantization error is equal to or less than an allowed error when converting an MDCT spectrum to an exponent portion and a power portion is calculated. If the total bit number is greater than a previously set bit rate, it is determined that the exponent portion is inappropriate. Then, in the AAC method, the exponent portion is modified, and again, the exponent portion of the MDCT spectrum is fixed and the power portion is quantized. Then an optimal exponent portion and an optimal power portion, with which a quantization error is below an allowed error and the total bit number is equal to or less than a set bit rate, are determined.

As described above, in the AAC method, after performing quantization and Huffman encoding, a needed total number of bits is calculated. Also, an optimal exponent portion and an optimal power portion, with which the total bit number is equal to or less than the allowed bit number allowed for a current frame, are determined. Here, an optimum state refers to when a quantization error is below the allowed error.

A typical noise reduction technology is performed only for a single frame size in a FFT region (by a FFT unit, and thus in order to apply the technology to a codec having frame size converting characteristics like MPEG AAC, that is, characteristics of converting a frame size into a long block and a short block, FFT and IFFT operations as illustrated in FIG. 1 are further required. Also, when a frequency domain conversion operation inside an audio codec is shared with a noise reduction operation, normal noise reduction is performed only with respect to frames of a predetermined size, and thus if a codec having frame size converting characteristics, highly unnatural audio signal processing results may be obtained due to discontinuous noise reduction. Thus, to perform efficient noise reduction in terms of a calculation amount and performance in a system based on a codec having frame size converting characteristics such as MPEG AAC, a frequency domain conversion operation is to be shared and multiple frame sizes are to be considered so that a result of noise reduction between frames may be expressed continuously. Also, in order to increase noise reduction performance versus a calculation amount when integrating elements in a codec, noise reduction is to be performed in consideration of a domain conversion format of the corresponding codec and a sub-band division structure that is defined for quantization.

According to audio signal encoding of the current embodiment, noise reduction in accordance with frame size converting characteristics is performed in a MDCT area by a MDCT unit of MPEG AAC, and during MPEG AAC encoding, noise reduction that is appropriate for multiple frame sizes and for an MPEG AAC encoding structure is applied inside an AAC encoder, thereby reducing a calculation amount and increasing noise reduction performance.

Figure 4:
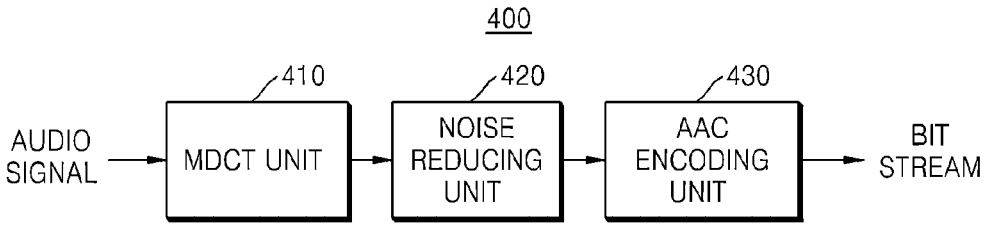
FIG. 4 is a schematic view illustrating an audio signal coding apparatus, according to an embodiment.

FIG. 4 is a schematic view illustrating an audio signal coding apparatus 400, according to an embodiment.

Referring to FIG. 4, the audio signal coding apparatus 400 includes an MDCT unit 410, a noise reducing unit 420, and an AAC encoding unit 430. The audio signal coding apparatus 400 corresponds to the AAC encoder of FIG. 2 to which the noise reducing unit 420 is further applied.

The MDCT unit 410 receives an audio signal to perform modified discrete cosine transformation (MDCT) to thereby convert the audio signal into long block frames or short block frames. As described with reference to FIG. 2, MDCT refers to converting an audio signal in a time domain into an audio signal in a frequency domain, and converting frames of an audio signal into long blocks and short blocks. According to the audio signal encoding of the current embodiment, an audio signal is converted either into long blocks of 1024 points or into short blocks of 128 points according to MPEG AAC. In addition, as illustrated in FIG. 2, the selector 207 performs long block MDCT or short block MDCT according to a result of determination of the block length determining unit 206, thus selectively performing noise reduction. That is, noise reduction is performed with respect to a long block or a short block according to block switching of AAC. Here, the long blocks or the short blocks may be in various sequences according to a form of an audio signal, and thus noise reduction is performed according to variable frame length characteristics.

The noise reducing unit 420 reduces noise in the audio signal according to the long block or the short block converted by using the MDCT unit 410. As the long blocks or the short blocks may be in various sequences, the noise reducing unit 420 performs noise reduction according to variable frame length characteristics. In the case of a long block, noise is directly eliminated based on spectral subtraction, that is, a frequency pattern of previously stored noise is reduced from an original audio signal. However, in the case of a short block, if noise is directly eliminated based on spectral subtraction, frequency resolution of the short block is greatly reduced to 128 points, and external effects such as musical noise or a decrease in sound quality are generated. Thus, noise reduction with respect to a short block is performed by spectral reduction based on a noise power reduction width after the noise reduction of a long block, that is, by adjusting a scaling factor of a signal. Noise reduction as described above will be described later in detail with reference to FIG. 5.

The AAC encoding unit 430 performs AAC encoding with respect to the long block or the short block which is output from the noise reducing unit 420 and from which noise is reduced, thereby outputting a bit stream. AAC encoding is as described above with reference to FIG. 2. According to block switching of a long block or a short block of the AAC encoding unit 430, the noise reducing unit 420 performs noise reduction with respect to a long block or a short block, and then the AAC encoding unit 430 performs encoding.

Figure 5:
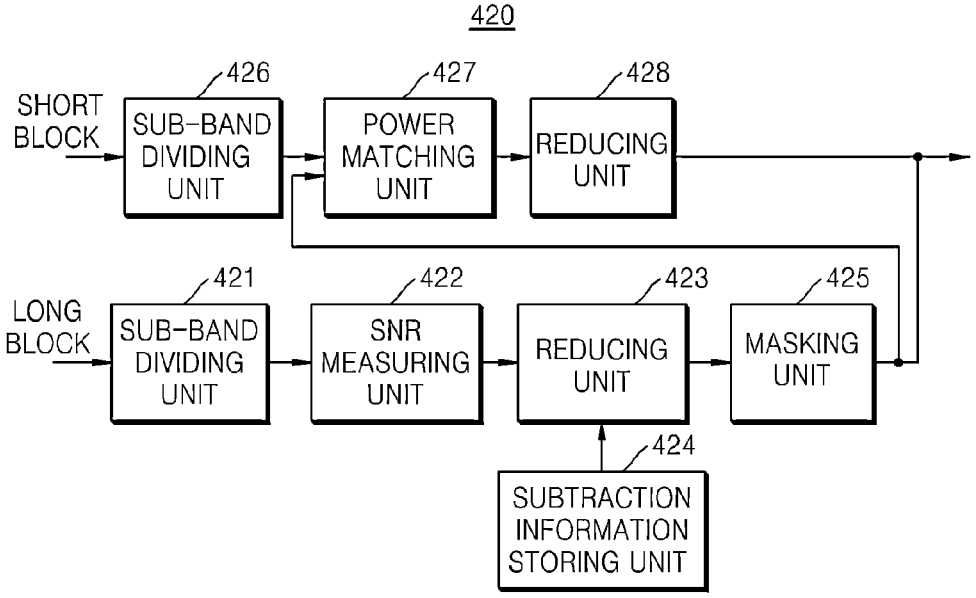
FIG. 5 is a block diagram illustrating a noise reducing unit illustrated in FIG. 4.

FIG. 5 is a detailed block diagram illustrating the noise reducing unit 420 illustrated in FIG. 4.

Referring to FIG. 5, the noise reducing unit 420 includes sub-band dividing units 421 and 426 that perform sub-band dividing with respect to a long block and a short block, a signal-to-noise ratio (SNR) measuring unit 422, a reducing unit 423, a subtraction information storing unit 424, a masking unit 425, a power matching unit 427, and a reducing unit 428. The noise reducing unit 420 performs non-linear multi-band spectral subtraction with respect to long blocks; and with respect to short blocks, the noise reducing unit 420 performs spectral reduction of adjusting a scaling factor of a sub-band of the short block based on the spectral subtraction of the long block. In other words, direct noise elimination is performed on a long block, and noise reduction of adjusting a scaling factor is performed on a short block. Here, to distinguish noise reduction of a long block and noise reduction of a short block, different terms, i.e., spectral subtraction and spectrum reduction, will be used respectively.

The noise reducing unit 420 according to the current embodiment is integrated in the MPEG AAC encoder illustrated in FIG. 2. The noise reducing unit 420 uses as an input signal, a MDCT coefficient for each frame, which is a calculation result of a filter bank module including signal process domain conversion such as FFT or discrete cosine transformation (DCT) which is necessary for noise reduction in a frequency band or MDCT conversion of an AAC encoder to avoid a relatively high calculation amount required by an inverse conversion module. Also, the noise reducing unit 420 not only uses the MDCT calculation result of the filter bank module but also maintains a corresponding long or short block structure in consideration of a variable frame length and a non-linear factor band used by the MPEG AAC encoder to perform noise reduction. The variable frame length characteristics are generated by block-switching, which is introduced by the MPEG AAC encoder to eliminate pre-echo or post-echo illustrated in FIG. 3B. The variable frame length characteristics are classified as a long block (or long type) of 1024 points and a short block (or short type) of 128 points by dividing frame sizes of an audio signal, and then a MDCT conversion coefficient suitable for each block is determined. A frame determination input about whether a long block or a short block is determined in the manner as described with reference to FIG. 2, and the long or short block may be shown in various sequences according to a form of an audio signal, and thus noise reduction is performed to be compatible with the variable frame length characteristics.

As illustrated in FIG. 5, while direct noise elimination based on spectral subtraction is performed on a long block frame, if the spectral subtraction is performed on a short block frame, a frequency resolution of the short block frame is greatly reduced to 128 points, and external effects such as musical noise or sound quality decrease are generated. Thus, for a short block frame, spectral reduction based on noise power reduction width after noise reduction of a previous long block frame is performed.

In the case of noise reduction for a long block, a non-linear multiband spectral reduction method, in which a scale factor band formed in consideration of auditory recognition characteristics of humans is used, is applied to maintain a frame structure of an MPEG AAC encoder, thereby enhancing of noise reduction performance. The non-linear multiband spectral reduction method is effective in removing white noise or colored noise, and is disclosed in "Perceptually weighted multi-band spectral subtraction speech enhancement technique," in Proc. International Conference on Electrical and Computer Engineering, pp. 20-22, December 2008 by M. F. A. Chowdhury, et al.

When a frame that is currently being coded is determined as a long block, the sub-band dividing unit 421 divides a long bock into a plurality of sub-bands. During noise reduction corresponding to a variable frame length, when a current frame is determined as a long block, the current frame is defined as a $49^{th}$ order non-uniform scale factor band. When a frame that is currently being coded is determined as a short block, the sub-band dividing unit 426 divides a short block into a plurality of sub-bands. The current frame is defined as a $14^{th}$ order non-uniform scale factor band.

The SNR measuring unit 422 measures a SNR of each of the sub-bands of the long block divided by the sub-band dividing unit 421.

Power of a noise pattern of a frame of a $49^{th}$ order non-uniform scale factor band defined by the sub-band dividing unit 421 and power of a sub-band are compared to obtain a SNR of each sub-band of a corresponding input frame. Typical SNR measurement is as expressed in Equation 1 below:

$$S_b(i) = 10\log_{10}\left(\frac{E[|Y(k)|]^2}{E[|N(k)|]^2}\right) \text{ where} \quad \text{[Equation 1]}$$

$$B_{i-1} \le k < B_i$$

|Y(k)| and |N(k)| respectively denote a MDCT coefficient of an input audio signal and a MDCT coefficient of a noise pattern. Also, Sb(i) denotes a SNR value of a corresponding sub-band, and B denotes a range index of a sub-band.

It is inefficient to calculate a SNR of each sub-band directly using Equation 1 in terms of calculation amounts. Thus, the SNR of each sub-band may be indirectly obtained by discretely setting a representation of the SNR and using a Comparative formula expressed in Equation 2.

$$(10^{(S_c(l)/20)}E[|N(k)|] \le E[|Y(k)|] < 10^{(S_c(l-1)/20)} E[|N(k)|]) \Rightarrow S_b(i) = S_c(l) \quad \text{[Equation 2]}$$

Sc(l) denotes SNR operations that are defined discretely, and the finer these operations, the more accurate SNR measurement of sub-bands are possible, but an increase in a calculation amount thereof is large. Thus, a point of compromise is required. According to the current embodiment, a total of ten SNR values are set from 21 dB to −3 dB in units of three dBs in consideration of an allowed calculation amount versus performance.

The reducing unit 423 performs spectral subtraction based on a SNR measured by the SNR measuring unit 422, information about a perceptual sound curve corresponding to the SNR, and subtraction coefficients in consideration of a weight for each sub-band. Here, the data about the perceptual sound quality curve is stored in the subtraction information storing unit 424, and the reducing unit 423 extracts the measured SNR and the information about the perceptual sound quality curve about the measured SNR, from the subtraction information storing unit 424.

The spectral subtraction performed by the reducing unit 423 is performed according to a subtraction coefficient T(i,l) which is calculated in consideration of the perceptual sound quality curve corresponding to the measured SNR ratio for each sub-band and weights of each sub-band, according to Equation 3 below.

$$X'(k) = (|Y(k)| - T(i,l)|N(k)|)\text{sgn}(Y(k)) \quad \text{[Equation 3]}$$

Here, X'(k) denotes a signal with respect to which spectral subtraction is performed, and when Y(k)≥0, sgn(Y(k))=1, and when Y(k)<0, sgn(Y(k))=−1. T(i,l) is expressed by the perceptual sound quality curve including weight information of subtraction function for each SNR and each sub-band, that is, P(i). P(i) is expressed as in Equation 4 below.

$$T(i, l) = \left(\frac{(G_{max} - G_{min})}{L-1}(l-1) + 1\right)P(i), \text{ where} \quad \text{[Equation 4]}$$

$$l = [1: L]$$

L denotes the number of a discrete SNR operation corresponding to Sc(l) of Equation 2, and Gmax and Gmin respectively denotes the largest and smallest ranges of T(i,l).

Figure 7:
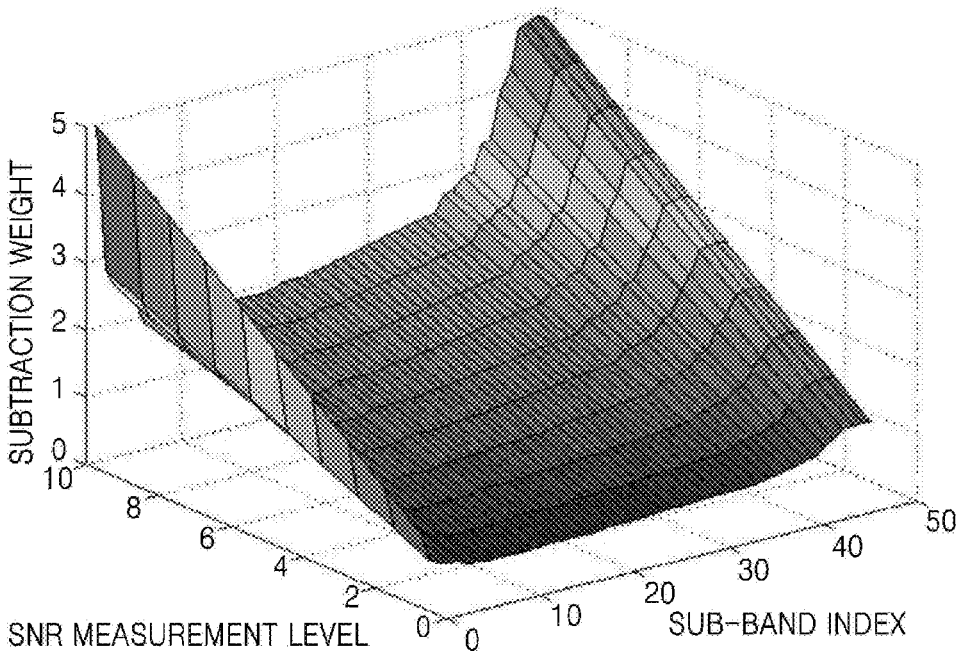
FIG. 7 is a three-dimensional graph of a subtraction coefficient T(i,l), according to an embodiment.

FIG. 7 is a three-dimensional graph of a subtraction coefficient T(i,l) according to an embodiment, where Gmax and Gmin are set as 5 and 1, respectively.

The masking unit 425 performs over-subtraction by amplifying the subtraction coefficient, and performs masking using an audio signal corresponding to a reduced long block.

Although the noise reduction according to Equation 4 allows efficient noise reduction regarding various noise situations when compared to a simple spectral subtraction method according to the conventional art where weights for respective bands are not considered, the problem of musical noise still exists. According to the current embodiment, in order to solve this problem, an over-subtraction method in which a subtraction coefficient is amplified to directly eliminate musical noise is performed, and then some low signal components of a SNR that disappear according to the over-subtraction are compensated for, and masking using a reduction original signal for reducing a recognition rate of residual musical noise is performed. This method is effective in reducing generation of musical noise at low cost within a platform of a portable device where an available calculation amount is limited, such as a smartphone, a digital camera, etc. Spectral subtraction where over-subtraction is applied is as expressed in Equation 5 below.

$$X'(k) = (|Y(k)| - \alpha T(i,l)|N(k)|)\text{sgn}(Y(k)) \quad \text{[Equation 5]}$$

α is a subtraction amplification variable, which is updated by determining whether each frame is a noise frame or a signal frame, and is used to adaptively adjust a degree of over-subtraction according to a frame type. Update of α is expressed by αprev of a previous frame, a modification constant Odiff, and limit constants Omin and Omax as in Equation 6 below.

$$f_{current} = NOISE \Rightarrow \alpha = \begin{cases} \alpha_{prev} + O_{diff} & \text{if } \alpha_{prev} < O_{max} \\ \alpha_{prev} & \text{else} \end{cases} \quad \text{[Equation 6]}$$

$$f_{current} = SIGNAL \Rightarrow \alpha = \begin{cases} \alpha_{prev} - O_{diff} & \text{if } \alpha_{prev} > O_{min} \\ \alpha_{prev} & \text{else} \end{cases}$$

fcurrent denotes a signal for determining whether a current frame is signal-centered or noise-centered, and a method of determining the same is illustrated in pseudo code illustrated in FIG. 8.

FIG. 8 is pseudo code for explaining a method of determining whether a current frame is signal-centered or noise-centered, according to an embodiment.

An MDCT coefficient that has undergone over-subtraction performs musical noise masking according to Equation 7 below.

$$X'(k)=[\{(|Y(k)|-\alpha T(i,l)|N(k)|)\mathrm{sgn}(Y(k))\}+\beta|Y(k)|]/(1+\beta) \quad \text{[Equation 7]}$$

β is a coefficient smaller than 1, and functions as a tuning parameter that adjusts a ratio of side effects such as a decrease in sound quality compared to noise reduction effects and generation of musical noise.

The power matching unit 427 compares an average power of an audio signal of a predetermined range according to noise reduction of the long block frame signal and an average power of an audio signal of the predetermined range of a short block corresponding to the long block frame signal provided by the masking unit 425, and determines a reduction rate of the short block frame signal, and the reducing unit 428 performs spectral reduction of adjusting a scaling factor with respect to the short block according to the determined reduction rate.

The power matching unit 427 and the reducing unit 428 perform noise reduction with respect to a $14^{th}$ order non-uniform scale factor band output from the sub-band dividing unit 426 with respect to the short block frame signal.

According to the current embodiment, if a current frame is determined as a short block frame signal, the overall signal is reduced by simple spectral reduction, thus maintaining consistent signal amplitude by power matching with a frame of a previous long block, on which spectral subtraction is performed. The overall spectral reduction reduces not only noise but also power of a signal component, thus distorting an original signal. However, a block switching module in a MPEG AAC encoder performs short block frame processing mostly in a short section where a signal in a time domain abruptly increases in amplitude in the form of an impulse, and thus total signal distortion is small.

An amount of spectral reduction of a short block frame is calculated by comparing an average power of an audio signal of a previous long block frame of a predetermined band and an average power of the short block frame of the same band.

The noise reduction according to the current embodiment may be integrated inside a MPEG AAC encoder, and when the noise reduction method is applied in a MPEG AAC based system, compared to the noise reduction method according to the conventional art, a calculation amount may be reduced while increasing noise reduction performance. Accordingly, the noise reduction may be applied to MPEG AAC-based audio recording devices such as smartphones, digital cameras, etc., with a low required calculation amount and memory, thereby increasing the range of application of the noise reduction method.

Figure 6:
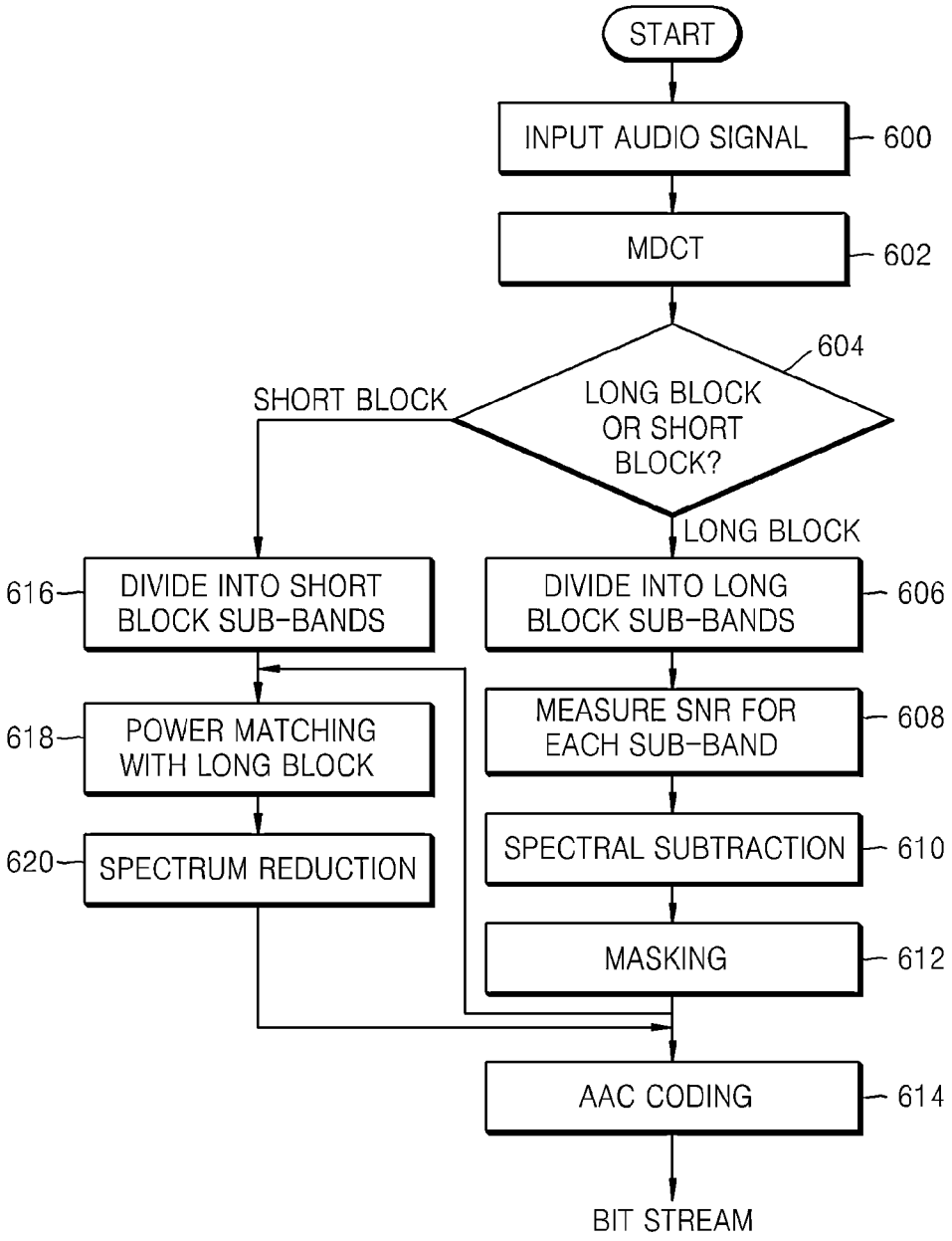
FIG. 6 is a flowchart illustrating a method of audio signal coding, according to another embodiment.

FIG. 6 is a flowchart illustrating a method of audio signal coding, according to another embodiment.

Referring to FIG. 6, in operations 600 and 602, an audio signal is received, and MDCT is performed on the audio signal. In operation 604, it is determined whether a current frame, on which AAC is to be performed, is a long block frame signal or a short block frame signal. According to the noise reduction of the current embodiment, noise reduction is performed on the long block frame signal or the short block frame signal according to block switching used in AAC. When the current frame to be processed is determined as a long block frame, in operation 606, the current frame is divided into long block sub-bands, that is, $49^{th}$ order non-uniform scale factor bands.

In operation 608, a SNR of each of the sub-bands is measured. During noise reduction corresponding to a variable frame length, when the current frame is determined as a long block, the frame is defined as a $49^{th}$ order non-uniform scale factor band, and a noise pattern of a 1 frame length defined as a scale factor band and power of the sub-band are compared to measure a SNR of each sub-band of a corresponding input frame. SNR measurement of each sub-band is as described above with reference to Equations 1 and 2 above.

In operation 610, spectral subtraction is performed by using the SNR of each sub-band measured in operation 608 and a subtraction coefficient that is calculated in consideration of weights based on perceptual sound curve corresponding to the SNR. Spectral subtraction is as described above with reference to Equations 3 and 4 above.

In operation 612, masking is performed. Although efficient noise reduction is performed for various noise situations compared to the spectral subtraction of operation 610, masking is performed to solve the problem of musical noise. Musical noise is a sinusoidal component that remains after noise is eliminated by a noise elimination gain, and this decreases sound quality. According to the current embodiment, over-subtraction of directly eliminating musical noise by amplifying a subtraction coefficient which is used in spectral subtraction in order to solve the musical noise is performed, and some low SNR signal components which are removed by the over-subtraction are compensated for, and masking using a reduction original signal is performed to reduce a recognition rate of residual musical noise. Accordingly, musical noise may be prevented in a platform of portable digital devices where an available calculation amount is limited, at low cost.

In operation 614, AAC is performed on a long block frame on which noise reduction is performed.

When a current frame being coded is determined as a short block frame in operation 604, the short block frame is divided into a plurality of sub-bands in operation 616. Here, a short block frame is defined as a $14^{th}$ order non-uniform scale factor band.

In operation 618, power matching is performed with the long block on which noise reduction is performed, to determine a reduction rate. In operation 620, spectral reduction is performed. When a current frame is determined as a short block, the overall signal is reduced simply by spectral reduction, and amplitude of the signal is maintained uniformly by power matching with the long block frame on which spectral subtraction is performed before. The overall spectral reduction performed in operation 620 reduces not only noise but also power of a signal component and thus distorts an original signal. However, a block switching module in a MPEG AAC encoder performs short block frame processing mostly in a short section where a signal in a time domain abruptly increases in amplitude in the form of an impulse, and thus total signal distortion is small.

Figure 9A:
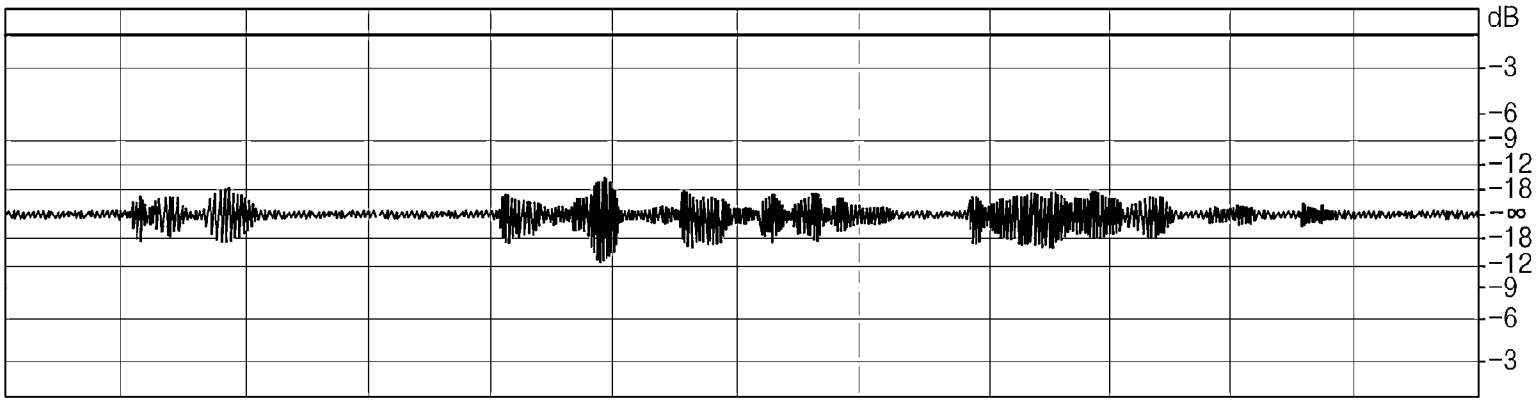
FIGS. 9A and 9B illustrate a signal waveform of an audio signal before and after applying an audio signal coding method, according to an embodiment.
Figure 9B:
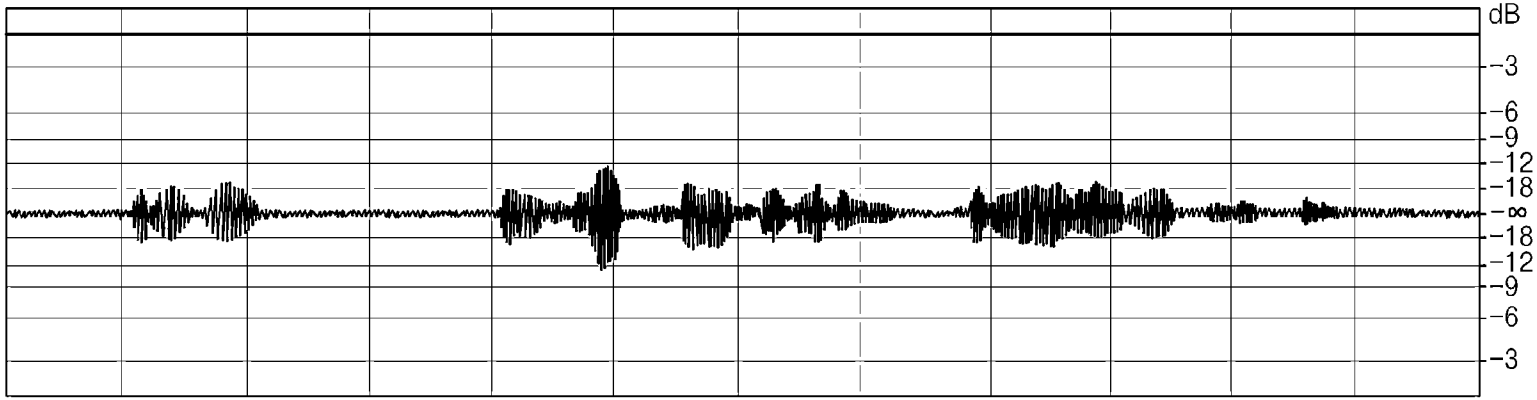

In operation 614, AAC is performed on the short block on which noise reduction is performed. Tables 1 through 3 below show results of experiments of testing performance of digital portable devices by mounting AAC modules for noise reduction according to the current embodiment in digital portable devices such as digital cameras, and FIGS. 9A and 9B illustrate a signal waveform of an audio signal before and after applying an audio signal coding method, according to an embodiment.

TABLE 1

| | average calculation amount in frame units |
|---|---|
| when the current embodiment is not applied | 87.81 MIPS |
| when the current embodiment is applied | 17.41 MIPS |

TABLE 2

| | SNR average SNR before noise reduction | SNR average after noise reduction |
|---|---|---|
| voice | 18.34 dB | 29.45 dB |
| classic | 21.23 dB | 27.93 dB |
| pop | 22.21 dB | 26.96 dB |
| average | 20.63 dB | 28.11 dB |

TABLE 3

| | Preference of signal before noise reduction | preference of signal after noise reduction |
|---|---|---|
| voice | 0% | 100% |
| classic | 9% | 91% |
| pop | 9% | 91% |
| average | 6% | 94% |

As illustrated in Table 1, when the noise reduction method according to the current embodiment is applied, a calculation amount was reduced by about 80.2%.

In measurement of the noise reduction performance, voice sources having an average SNR of 20.63 dB were tested, and SNR reduction thereof when applying the noise reduction method according to the current embodiment and average preferences of the voice sources before and after noise reduction were examined. As shown in Table 2, an average SNR after applying the noise reduction method was increased by 7.48 dB from that before applying the method, and preference for the voice sources to which the noise reduction method was applied was 94% on average as shown in Table 3.

According to audio signal coding of the embodiments, noise reduction is performed in accordance with frame size conversion characteristics in a MDCT region of MPEG AAC, and when performing MPEG AAC encoding, noise reduction that is suitable for multiple frame sizes and MPEG AAC encoding structures is applied in an AAC encoder, thereby reducing an amount of calculation and improving noise reduction performance.

The device described herein may include a processor, a memory for storing program data, a permanent storage device such as a disk drive, a communications port for handling communications with external devices, and user interface devices, including a display, a keyboard, etc. When software modules are involved, these software modules may be stored as program instructions or computer readable codes executable by the processor, in computer-readable media such as magnetic storage media (e.g., read-only memory (ROM), random-access memory (RAM), floppy disks, hard disks, etc.) and optical recording media (e.g., CD-ROMs, DVDs, etc.). The computer readable recording medium can also be distributed over network coupled computer systems so that the computer readable code is stored and executed in a distributed fashion. This media can be read by the computer, stored in the memory, and executed by the processor.

All references, including publications, patent applications, and patents, cited herein are hereby incorporated by reference to the same extent as if each reference were individually and specifically indicated to be incorporated by reference and were set forth in its entirety herein.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The invention may be described in terms of functional block components and various processing steps. Such functional blocks may be realized by any number of hardware and/or software components configured to perform the specified functions. For example, the invention may employ various integrated circuit components, e.g., memory elements, processing elements, logic elements, look-up tables, and the like, which may carry out a variety of functions under the control of one or more microprocessors or other control devices. Similarly, where the elements of the invention are implemented using software programming or software elements the invention may be implemented with any programming or scripting language such as C, C++, Java, assembler, or the like, with the various algorithms being implemented with any combination of data structures, objects, processes, routines or other programming elements. Functional aspects may be implemented in algorithms that are executed on one or more processors. Furthermore, the invention could employ any number of conventional techniques for electronics configuration, signal processing and/or control, data processing and the like. The words "mechanism" and "element" are used broadly and are not limited to mechanical or physical embodiments, but can include software routines in conjunction with processors, etc.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical".

The use of the terms "a" and "an" and "the" and similar referents in the context of describing the invention (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the spirit and scope of the present invention.

While the invention has been particularly shown and described with reference to exemplary embodiments thereof, it will be understood by those of ordinary skill in the art that various changes in form and details may be made therein without departing from the spirit and scope of the invention as defined by the following claims.

What is claimed is:

1. An audio signal coding method for noise reduction, the method comprising:

receiving an audio signal and performing modified discrete cosine transformation (MDCT) on the audio signal to convert the audio signal into long blocks or short blocks;

reducing noise of the audio signal in accordance with a long block or a short block; and performing advanced audio coding (AAC) on the long block or the short block in which noise is reduced, wherein in the reducing of noise, a non-linear multi-band spectral subtraction is performed on the long block, and a spectral reduction is performed on the short block based on the spectral subtraction of the long block.

2. The method of claim 1, wherein the reducing of noise is performed using a MDCT coefficient according to the MDCT.

3. The method of claim 1, wherein the reducing of noise is performed by dividing the audio signal into a long block of 1024 points or a short block of 128 points according to block switching of the AAC.

4. The method of claim 1, further comprising storing the audio signal, to which the AAC is performed, in a recording medium.

5. An audio signal coding method for noise reduction, the method comprising:

receiving an audio signal and performing modified discrete cosine transformation (MDCT) on the audio signal to convert the audio signal into long blocks or short blocks;

reducing noise of the audio signal in accordance with a long block or a short block; and performing advanced audio coding (AAC) on the long block or the short block in which noise is reduced, wherein the reducing of noise comprises:

dividing the long block into a plurality of sub-bands;

measuring a signal-to-noise ratio (SNR) of each of the plurality of sub-bands; and performing spectral subtraction based on information about a perceptual sound quality curve corresponding to the measured SNR and a subtraction coefficient calculated in consideration of a weight of each of the plurality of sub-bands.

6. The method of claim 5, further comprising performing over-subtraction by amplifying the subtraction coefficient, and performing masking using an audio signal corresponding to the reduced long block.

7. An audio signal coding method for noise reduction, the method comprising:

receiving an audio signal and performing modified discrete cosine transformation (MDCT) on the audio signal to convert the audio signal into long blocks or short blocks;

reducing noise of the audio signal in accordance with a long block or a short block; and performing advanced audio coding (AAC) on the long block or the short block in which noise is reduced, wherein a noise reduction rate with respect to the short block is determined by comparing an average power of an audio signal of a predetermined range according to noise reduction of the long block and an average power of an audio signal of the predetermined range of a short block corresponding to the long block.

8. An audio signal coding method for noise reduction, the method comprising:

receiving an audio signal and performing modified discrete cosine transformation (MDCT) on the audio signal to convert the audio signal into long blocks or short blocks;

reducing noise of the audio signal in accordance with a long block or a short block; and performing advanced audio coding (AAC) on the long block or the short block in which noise is reduced, wherein the reducing of noise is performed based on a variable frame length of the audio signal needed for the AAC and a non-linear scale factor band.

9. An audio signal coding method for noise reduction, the method comprising:

receiving an audio signal and performing modified discrete cosine transformation (MDCT) on the audio signal to convert the audio signal into long blocks or short blocks;

reducing noise of the audio signal in accordance with a long block or a short block; and performing advanced audio coding (AAC) on the long block or the short block in which noise is reduced, wherein the reducing of noise is performed by dividing the long block into $49^{th}$ order non-uniform sub-bands.

10. An audio signal coding method for noise reduction, the method comprising:

receiving an audio signal and performing modified discrete cosine transformation (MDCT) on the audio signal to convert the audio signal into long blocks or short blocks;

reducing noise of the audio signal in accordance with a long block or a short block; and performing advanced audio coding (AAC) on the long block or the short block in which noise is reduced, wherein the reducing of noise is performed by dividing the short block into $14^{th}$ order non-uniform sub-bands.

11. A non-transitory computer readable recording medium having embodied thereon a program for executing the method of claim 1 on a computer.

12. An audio signal encoding apparatus comprising:

a modified discrete cosine transformation (MDCT) converting unit that receives an audio signal and performs MDCT on the audio signal to convert the audio signal into long blocks or short blocks;

a noise reducing unit that reduces noise in the audio signal in accordance with a long block and a short block; and an advanced audio coding (AAC) encoding unit that performs AAC on the long block or the short block in which noise is reduced, wherein the noise reducing unit performs non-linear multi-band spectral subtraction on the long block, and spectral reduction on the short block based on the spectral subtraction of the long block.

13. The audio signal encoding apparatus of claim 12, wherein the noise reducing unit performs noise reduction using a MDCT coefficient output from the MDCT unit.

14. The audio signal encoding apparatus of claim 12, wherein the noise reducing unit performs noise reduction by dividing the audio signal into a long block of 1024 points or a short block of 128 points according to block switching of the AAC.

15. An audio signal encoding apparatus comprising:

a modified discrete cosine transformation (MDCT) converting unit that receives an audio signal and performs MDCT on the audio signal to convert the audio signal into long blocks or short blocks;

a noise reducing unit that reduces noise in the audio signal in accordance with a long block and a short block; and an advanced audio coding (AAC) encoding unit that performs AAC on the long block or the short block in which noise is reduced, wherein the noise reducing unit comprises:

a long block sub-band dividing unit that divides the long block into a plurality of sub-bands;

a SNR measuring unit that measures a SNR of each of the sub-bands;

a subtracting unit that performs spectral subtraction based on information about a perceptual sound curve corresponding to the measured SNR and a weight for each of the sub-bands; and a masking unit that performs over-subtraction by amplifying the subtraction coefficient, and performing masking using an audio signal corresponding to the reduced long block.

16. An audio signal encoding apparatus comprising:

a modified discrete cosine transformation (MDCT) converting unit that receives an audio signal and performs MDCT on the audio signal to convert the audio signal into long blocks or short blocks;

a noise reducing unit that reduces noise in the audio signal in accordance with a long block and a short block; and an advanced audio coding (AAC) encoding unit that performs AAC on the long block or the short block in which noise is reduced, wherein the noise reducing unit comprises:

a short block sub-band dividing unit that divides the short block into a plurality of sub-bands;

a power matching unit that compares an average power of an audio signal of a predetermined range according to noise reduction of the long block and an average power of an audio signal of the predetermined range of a short block corresponding to the long block provided by the masking unit, and determines a reduction rate of the short block; and a reducing unit that performs noise reduction on the short block according to the determined reduction rate.

17. An audio signal encoding apparatus comprising:

a modified discrete cosine transformation (MDCT) converting unit that receives an audio signal and performs MDCT on the audio signal to convert the audio signal into long blocks or short blocks;

a noise reducing unit that reduces noise in the audio signal in accordance with a long block and a short block; and an advanced audio coding (AAC) encoding unit that performs AAC on the long block or the short block in which noise is reduced, wherein the noise reducing unit performs noise reduction based on a variable frame length of the audio signal needed for the AAC and a non-linear scale factor band.

18. An audio signal encoding apparatus comprising:

a modified discrete cosine transformation (MDCT) converting unit that receives an audio signal and performs MDCT on the audio signal to convert the audio signal into long blocks or short blocks;

a noise reducing unit that reduces noise in the audio signal in accordance with a long block and a short block; and an advanced audio coding (AAC) encoding unit that performs AAC on the long block or the short block in which noise is reduced, wherein the noise reducing unit performs noise reduction by dividing the long block into $49^{th}$ order non-uniform sub-bands, and by dividing the short block into $14^{th}$ order non-uniform sub-bands.

* * * * *